United States Patent [19]

Wood

[11] Patent Number: 4,902,935

[45] Date of Patent: Feb. 20, 1990

[54] METHOD AND APPARATUS FOR EVENING OUT THE TEMPERATURE DISTRIBUTION OF ELECTRODELESS LAMP BULBS

[75] Inventor: Charles H. Wood, Rockville, Md.

[73] Assignee: Fusion Systems Corporation, Rockville, Md.

[21] Appl. No.: 213,041

[22] Filed: Jun. 29, 1988

[51] Int. Cl.[4] ..... H01J 17/28

[52] U.S. Cl. ..... 315/112; 315/118; 315/248; 313/13; 313/44; 313/231.61; 362/373; 362/386

[58] Field of Search ..... 315/112, 117, 118, 248; 313/12, 13, 35, 44, 148, 231.61; 362/373, 386

[56] References Cited

U.S. PATENT DOCUMENTS

| | | | |
|---|---|---|---|
| 4,485,332 | 11/1984 | Ury et al. | 315/112 |
| 4,501,993 | 2/1985 | Mueller et al. | 315/248 |
| 4,507,587 | 3/1985 | Wood et al. | 315/39 |
| 4,695,757 | 9/1987 | Ury et al. | 313/44 |

*Primary Examiner*—Eugene R. LaRoche
*Assistant Examiner*—Truc Nguyen
*Attorney, Agent, or Firm*—Pollock, Vande Sande & Priddy

[57] ABSTRACT

An electrodeless lamp bulb is rotated about an axis which is at a designated angle to the predominant direction of the electrical field. This has the effect of evening out the temperature distribution about the bulb and reducing the formation of hot and cold spots.

19 Claims, 3 Drawing Sheets

FIG.1
PRIOR ART
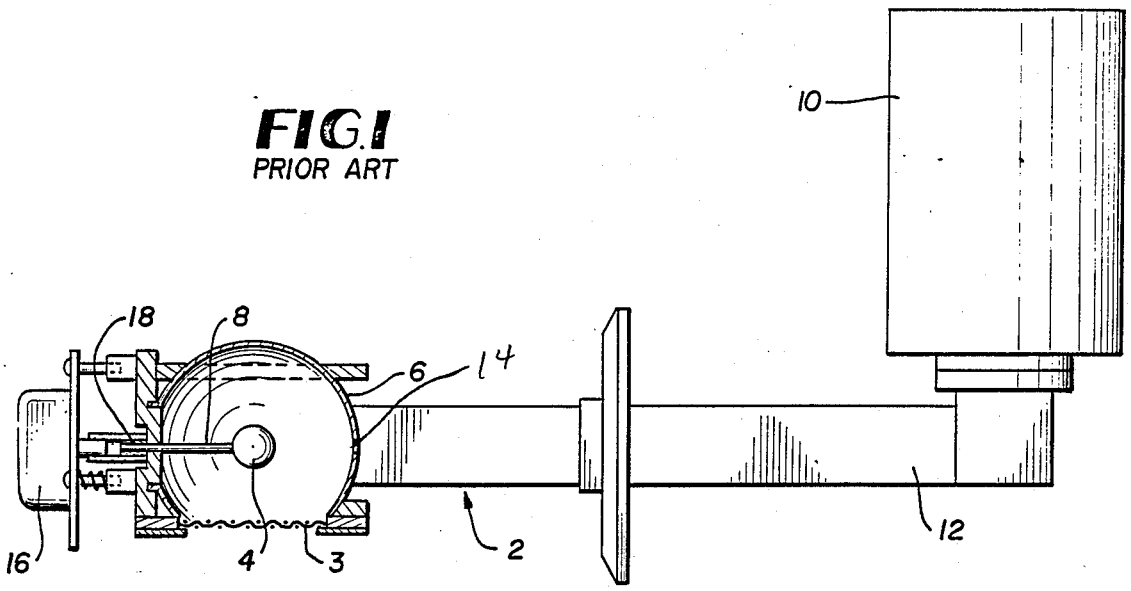
FIG.2
PRIOR ART
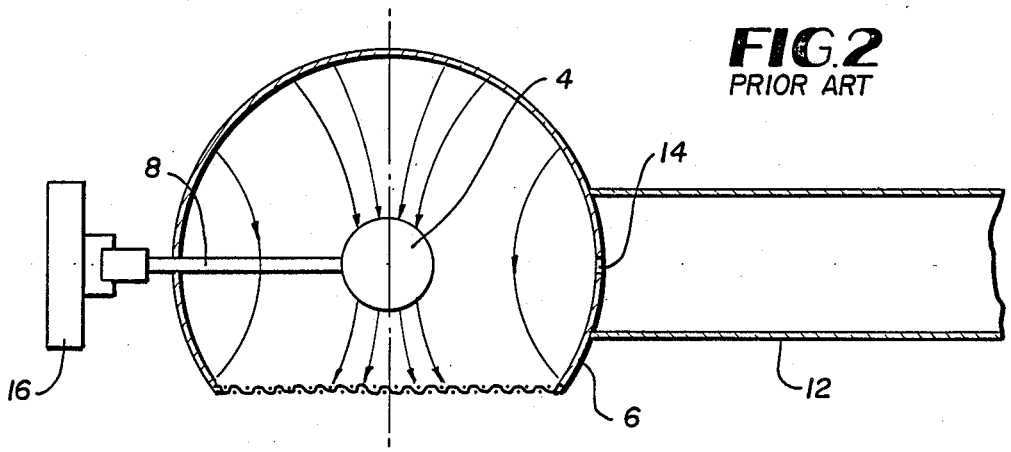
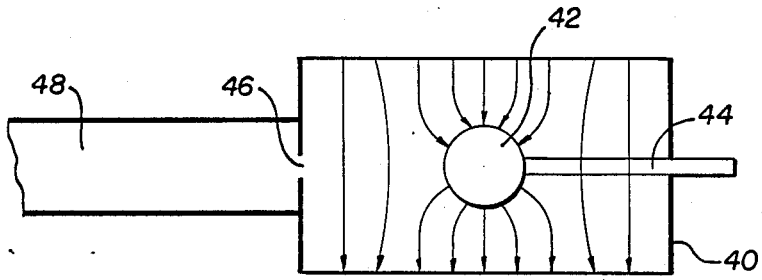
FIG.6

FIG. 3
PRIOR ART
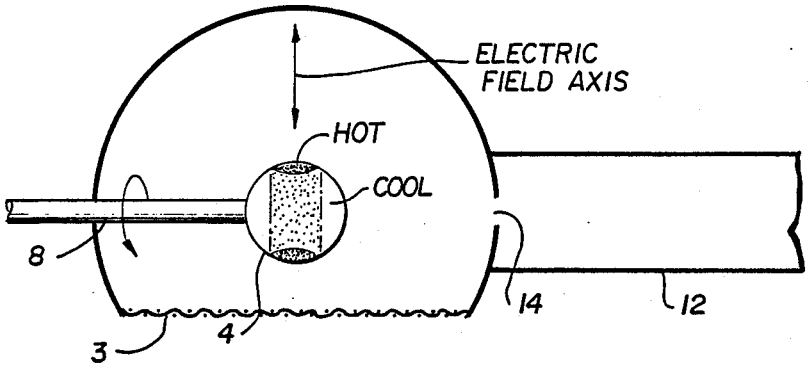
FIG. 4
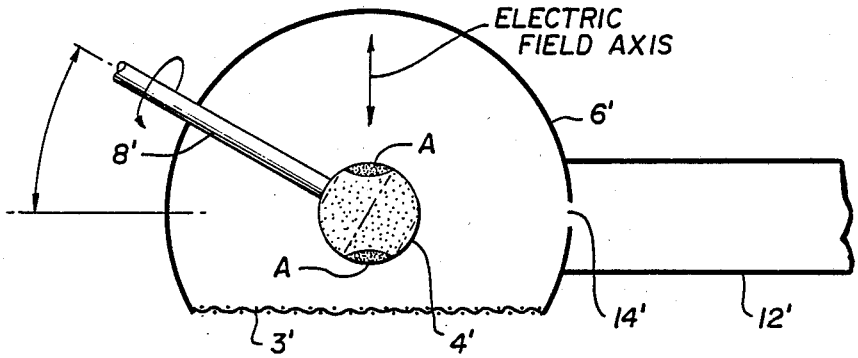
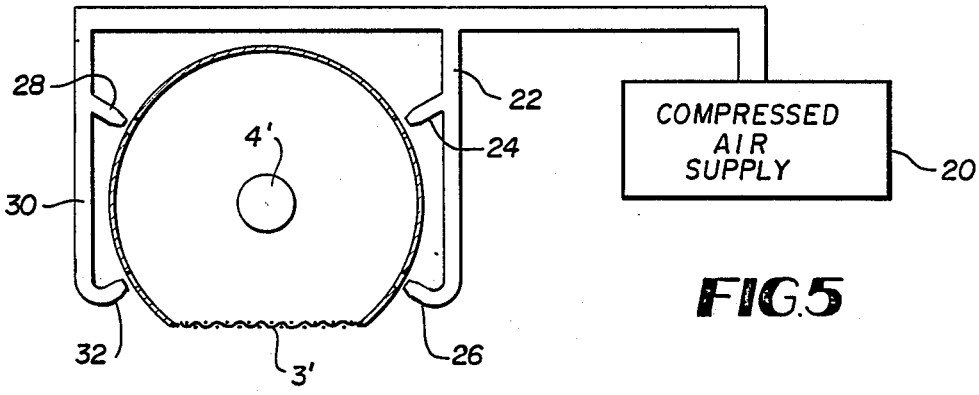
FIG. 5
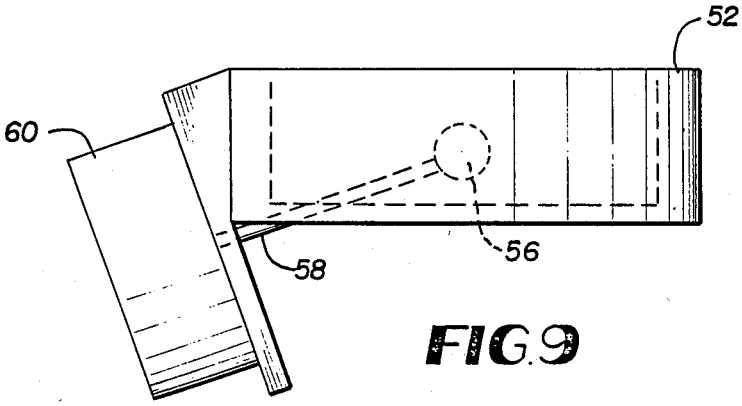
FIG. 9

METHOD AND APPARATUS FOR EVENING OUT THE TEMPERATURE DISTRIBUTION OF ELECTRODELESS LAMP BULBS

The present invention relates to a method and apparatus for evening out the temperature distribution of electrodeless lamp bulbs.

It is known that the bulbs in electrodeless lamps get extremely hot during operation, and must be effectively cooled. The heating of such bulbs puts an upper limit on the power density of the electromagnetic energy which can be coupled to the bulbs and therefore on the brightness of the light which can be emitted by the bulbs.

In U.S. Pat. Nos. 4,485,332 and 4,695,757, owned by the assignee of the present application, the idea of providing relative rotation between the lamp bulb and streams of cooling fluid which are impinged on the bulb is disclosed. This system provided a great improvement over the prior art, wherein the bulb was kept stationary and cooling fluid was merely directed at it. In co-pending application No. 073,670, a method of high speed bulb rotation is disclosed, which results in a more even temperature distribution about the bulb wall.

For some applications, even more uniform temperature wall loading than is taught by the above-mentioned U.S. Pat. Nos. 4,485,332 and 4,695,757 is required. For example, some fill materials, such as the rare earth halides (e.g., dysprosium iodide) vaporize only near the upper temperature limits of the synthetic quartz bulb wall. The temperature differential on the bulb using the patented prior art rotating cooling method may be so great that these fill materials can condense on the coldest part of the bulb, yet the high temperature of the hottest part of the bulb shortens the bulb life.

With better uniformity in wall loading, the bulbs hottest spot will be cooler and the bulb's coolest spot will be warmer. This will allow higher vapor pressures of the fill material to be maintained which produces greater operating efficiency.

In the systems disclosed in the above-mentioned patents, the bulb is rotated around an axis which is either perpendicular or parallel to the direction of the electric field in the microwave cavity. This resulted in hot spots or a hot band around the equator of the bulb and much cooler areas at the poles.

The present inventor has discovered that if the angle between the bulb rotation axis and the electric field is made other than 90° or 0°, the temperature distribution about the bulb is evened out, and the tendency for temperature sensitive fill material to condense is reduced. In accordance with the invention, this angle is arranged to be between about 30° and 70° or equivalently, between about 110° and 150°, and is most preferably between about 40° and 60° or equivalently, between about 120° and 140°.

The present invention thus comprises a method of evening out the temperature distribution of an electrodeless lamp bulb by rotating the bulb in predetermined angular relation to the direction of the electrical field, as well as apparatus for carrying out such method.

The invention will be better understood by referring to the accompanying drawings, in which:

FIG. 1 is a pictorial illustration of a prior art rotational bulb cooling system.

FIG. 2 illustrates the direction of the electric field in the system of FIG. 1.

FIG. 3 illustrates the hot and cold areas of the bulb in the system of FIG. 1.

FIG. 4 is an illustration of an embodiment of the present invention.

FIG. 5 illustrates an arrangement of cooling nozzles which may be used in connection with the embodiment of FIG. 4.

FIG. 6 shows a microwave lamp which uses a cavity of cylindrical shape.

FIG. 9 is a detail of FIG. 7, which shows the bulb mounting arrangement.

Figure 7:
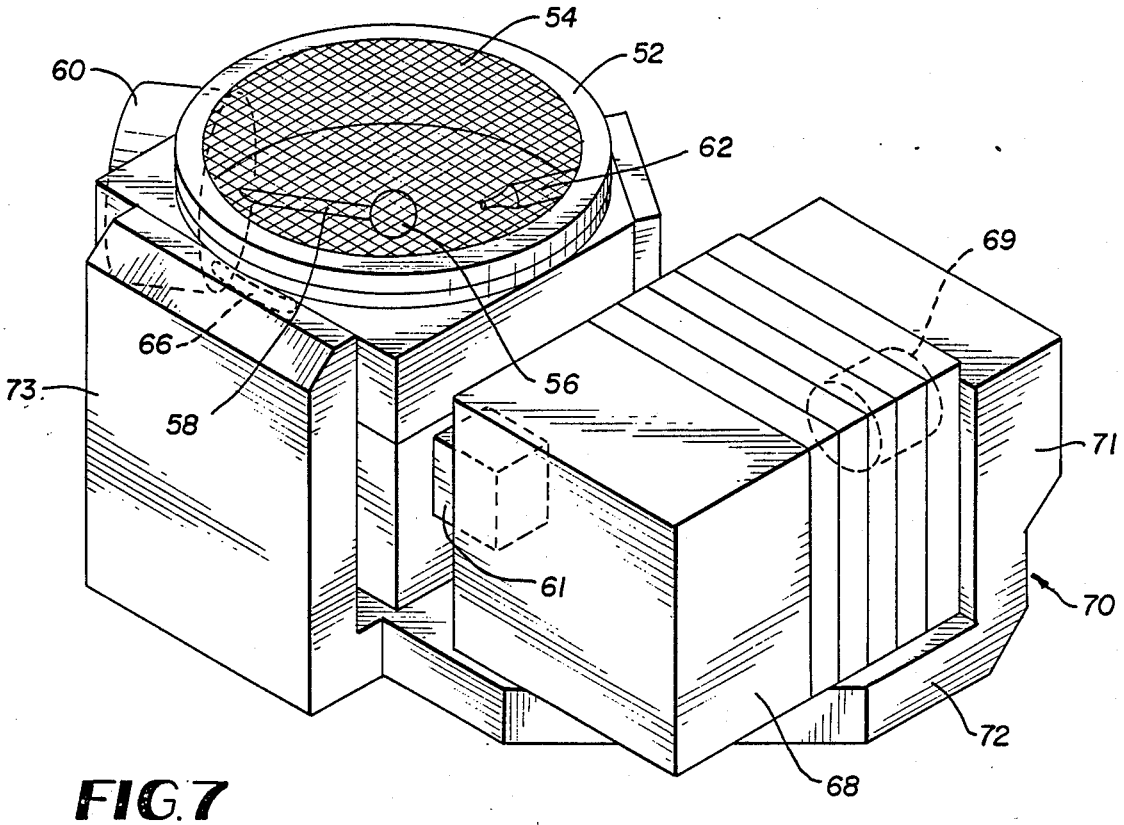
FIG. 7 and 8 are illustrations of a further embodiment of the present invention.

Referring to FIG. 1, which is an illustration of the prior art rotational cooling system disclosed in the above-mentioned U.S. Pat. No. 4,485,332, it is seen that bulb 4 is located in a microwave cavity comprised of spherical solid portion 6 and plane mesh 3. Microwave energy generated by magnetron 10 is fed by waveguide 12 to the microwave cavity, which it enters via coupling slot 14.

The bulb 4 is mounted by bulb stem 8 which is rotated by motor 16, which is secured to the cavity by mounting arrangement 18. Thus, the motor rotates bulb 4 while streams of cooling fluid are impinged on it to cool the bulb.

FIG. 2 shows the direction of the electric field in the lamp of FIG. 1, and it is seen that the predominant direction of the field at the bulb is perpendicular to the axis of rotation of the bulb.

If in the arrangement shown in FIGS. 1 and 2, the bulb were not rotated, two hot spots at the center top and center bottom of the bulb respectively would result, while relatively cool areas displaced by 90° around the spherical bulb would also exist. As may be seen by referring to FIG. 3, rotating the bulb in accordance with the prior art causes the two hot "spots" to become a hot band. Thus, if the area where the bulb stem meets the bulb and its opposite area directly across the bulb are denoted as the poles, then the bulb has a hot band around the equator and cool areas at the poles.

In this prior art cooling system, nozzles for impinging cooling fluid were disposed in the spherical cavity in a plane lying in the plane of the equator of the bulb, and the nozzles were pointed at the hot band around the equator.

An embodiment of the present invention is illustrated in FIG. 4, wherein it is seen that the axis of rotation of the bulb is angularly displaced from its location in the prior art. This causes two separate hot bands to be formed instead of a single hot band, with the result that the overall surface of the bulb is heated more uniformly. Parts of these respective bands are denoted by the letter A in FIG. 4.

The optimum angle of rotation axis offset may be different in different microwave cavities, or when using different cooling jet geometries. This angle may be from about 20° to about 60°, and is most preferably from about 30° to about 50°. Since the offset may be in either direction from the prior art axis, the angle between the new axis of rotation and the predominant direction of the electric field will be from about 30° to about 70° or from about 110° to about 150°, and is most preferably between about 40° and 60° or between about 120° and 140°.

A possible cooling fluid configuration is shown in FIG. 5. Here, cooling nozzles 24, 26, 28, and 32 are disposed about holes in the spherical cavity which are located in a plane in the cavity which also lies in the plane of the bulb equator. However, unlike in the prior art arrangement where the nozzles were pointed at the equator, in the present embodiment, the nozzles would be offset so as to be pointed at the respective hot bands.

FIG. 6 shows an electrodeless lamp utilizing a cylindrical cavity 40, which is fed with microwave energy from waveguide 48 through slot 46. Bulb 42 is supported in the cavity by stem 44, which in the prior art was rotated by a motor (not shown). As can be seen, the predominant direction of the electric field is perpendicular to the bulb stem.

Figure 8:
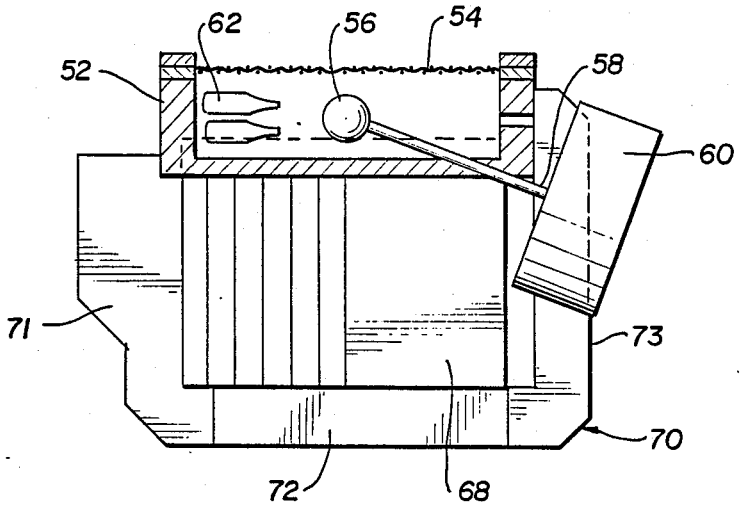

FIGS. 7 to 9 illustrate an embodiment of the present invention utilizing a cylindrical cavity, wherein the direction of the bulb stem is angularly displaced. As can be seen in these Figures, bulb 56 in cavity 52 is supported by bulb stem 58 which is rotated by motor 60, in such manner that the bulb stem is at an angle to the perpendicular to the electric field direction. As previously discussed, this angle is between about 20° and 60°, and is preferably between about 30° and 50°.

While bulb 56 is rotated, cooling fluid from nozzles 62 is impinged on the bulb. These nozzles are mounted so as to be pointed at the hot bands on the bulb.

In the embodiment of FIGS. 7 to 9, microwave energy generated by antenna 69 of magnetron 68 is fed to waveguide 70, which feeds the energy to cavity 52 through slot 66. The waveguide 70 is bent, and is comprised of waveguide sections 71, 72, and 73.

It should be noted that the invention is applicable to electrodeless lamps wherein the bulb is disposed in a single microwave field, as it is this situation which results in an uneven temperature distribution. In lamps utilizing multiple fields, such as disclosed in U.S. Pat. No. 4,749,915, the temperature distributions caused by individual fields tend to offset each other so that a more uniform overall temperature is obtained.

There thus has been described an improved method and apparatus for equalizing the thermal loading of a bulb wall in an electrodeless lamp. While illustrative embodiments have been disclosed using cavities of certain shapes and a spherical bulb, it is to be understood that cavities and bulbs of other shapes may be used. Additionally, other variations of the invention may occur to those skilled in the art, but it is to be understood that the invention disclosed herein is to be limited only by the claims appended hereto and equivalents.

I claim:

1. In an electrodeless lamp, a method of evening out the temperature distribution of the bulb wall, comprising the steps of, providing an electrodeless lamp including a bulb containing a gaseous fill which is disposed in only one electromagnetic field, which field has an electric field component which is predominantly in a first direction, and rotating the bulb about an axis which is at an angle of between about 30° and about 70° or between about 110° and about 150°, with said first direction.

2. The method of claim 1 wherein said angle is either between about 40° and about 60° or between about 120° and about 140°.

3. The method of claim 2 wherein the electrodeless lamp further includes a microwave cavity in which said bulb is disposed and wherein said electromagnetic field comprises a microwave field.

4. The method of claim 3 wherein said electromagnetic field is generated by only a single magnetron.

5. The method of claim 4 wherein said cavity has only a single coupling slot therein for coupling microwave energy.

6. The method of claim 2 wherein said bulb is of spherical shape.

7. The method of claim 3 wherein said bulb is spherical in shape.

8. The method of claim 2 wherein cooling fluid is impinged on said bulb as it is rotated.

9. The method of claim 3 wherein cooling fluid is impinged on said bulb as it is rotated.

10. An electrodeless lamp comprising, a microwave cavity, a bulb containing a gaseous medium disposed in said cavity, means for generating microwave energy, means for coupling said microwave energy to said cavity in such manner that only one electric field is set up in said cavity, which electric field is predominantly in a first direction, and means for rotating said bulb about an axis which is at an angle of between about 30° and about 70° or between about 110° and 150°, with said first direction.

11. The electrodeless lamp of claim 10 wherein said means for generating microwave energy comprises a single magnetron, and said means for coupling comprises a single coupling slot in said cavity.

12. The electrodeless lamp of claim 11 wherein said angle is either between about 40° and about 60° or between about 120° and about 140°.

13. The electrodeless lamp of claim 12 wherein said means for rotating the bulb comprises a motor and a stem disposed between the motor and bulb.

14. The electrodeless lamp of claim 13 wherein the cavity is spherical in shape.

15. The electrodeless lamp of claim 13 wherein the cavity is cylindrical in shape.

16. The electrodeless lamp of claim 12 wherein the bulb is spherical in shape.

17. The electrodeless lamp of claim 15 wherein the bulb is spherical in shape.

18. The electrodeless lamp of claim 12 further including means for impinging cooling fluid on said bulb as it is rotated.

19. The electrodeless lamp of claim 16 further including means for impinging cooling fluid on said bulb as it is rotated.

* * * * *